US010322731B2

(12) United States Patent
Distler et al.

(10) Patent No.: US 10,322,731 B2
(45) Date of Patent: Jun. 18, 2019

(54) SECONDARY SPRING HAVING AN INTEGRATED TRANSVERSE STOP

(71) Applicant: SIEMENS MOBILITY GMBH, Munich (DE)

(72) Inventors: Helmut Distler, Schwabach (DE); Michael Sumnitsch, Graz (AT)

(73) Assignee: Siemens Mobility GmbH, Munich (DE)

( * ) Notice: Subject to any disclaimer, the term of this patent is extended or adjusted under 35 U.S.C. 154(b) by 387 days.

(21) Appl. No.: 15/100,128

(22) PCT Filed: Nov. 13, 2014

(86) PCT No.: PCT/EP2014/074439
§ 371 (c)(1),
(2) Date: May 27, 2016

(87) PCT Pub. No.: WO2015/078695
PCT Pub. Date: Jun. 4, 2015

(65) Prior Publication Data

US 2017/0001651 A1 Jan. 5, 2017

(30) Foreign Application Priority Data

Nov. 29, 2013 (DE) ..... 10 2013 224 601

(51) Int. Cl.
*B61F 5/08* (2006.01)
*B61F 5/12* (2006.01)
(Continued)

(52) U.S. Cl.
CPC ..... *B61F 5/08* (2013.01); *B61F 5/10* (2013.01); *B61F 5/12* (2013.01); *B61F 5/14* (2013.01);
(Continued)

(58) Field of Classification Search
CPC ..... B61F 5/06; B61F 5/08; B61F 5/10; B61F 5/04; B61F 5/14; B61F 5/148; B61F 5/12; B61D 3/00; B61C 3/00
See application file for complete search history.

(56) References Cited

U.S. PATENT DOCUMENTS 2,220,581 A * 11/1940 Piron ..... B60G 11/22 267/35
2,955,547 A * 10/1960 Ebenbach ..... B61F 5/10 105/139
(Continued)

FOREIGN PATENT DOCUMENTS

AT 511876 A1 3/2013
CN 102963388 A 3/2013
(Continued)

*Primary Examiner* — Robert J McCarry, Jr.
*Assistant Examiner* — Scott A Browne
(74) *Attorney, Agent, or Firm* — Laurence Greenberg; Werner Stemer; Ralph Locher

(57) ABSTRACT

A secondary spring for a rail vehicle springs a wagon body of the rail vehicle on the chassis of the rail vehicle. The secondary spring is divided along a predefined axis into a first and at least one further, second section. The first section is configured to be axially stiff and springy orthogonally to the predefined axis, and the second section is configured to be stiff orthogonally to the predefined axis and axially springy. The secondary spring contains at least one horizontal stop, which is arranged on the secondary spring such that a force which acts on the horizontal stop orthogonally to the predefined axis is introduced into the secondary spring between the first and the second section.

6 Claims, 2 Drawing Sheets

(51) Int. Cl.

| | |
|---|---|
| ***B61F 5/14*** | (2006.01) |
| ***B61F 5/10*** | (2006.01) |
| *B61C 3/00* | (2006.01) |
| *B61D 3/00* | (2006.01) |

(52) U.S. Cl.
CPC ..... *B61F 5/148* (2013.01); *B61C 3/00* (2013.01); *B61D 3/00* (2013.01)

(56) References Cited

U.S. PATENT DOCUMENTS

| | | | | |
|---|---|---|---|---|
| 3,830,166 | A * | 8/1974 | Dieling | B61D 13/00 105/131 |
| 4,076,434 | A * | 2/1978 | Sperner | B60G 11/22 403/120 |
| 8,047,514 | B2 | 11/2011 | Wolf et al. | |
| 8,596,202 | B2 * | 12/2013 | Rodet | B61C 9/52 105/133 |
| 2006/0170140 | A1 * | 8/2006 | Menk | F16F 1/40 267/35 |
| 2011/0031662 | A1 * | 2/2011 | Toyama | B61F 5/02 267/121 |
| 2014/0261061 | A1 | 9/2014 | Chu et al. | |
| 2014/0306387 | A1 | 10/2014 | Kreuzweger | |

FOREIGN PATENT DOCUMENTS

| | | | | |
|---|---|---|---|---|
| DE | 19608179 | A1 | 9/1997 | |
| DE | 102004025765 | A1 | 12/2004 | |
| EP | 2000383 | A2 | 12/2008 | |
| EP | 2251562 | A1 | 11/2010 | |
| FR | 2896220 | A1 | 7/2007 | |
| WO | WO-2013029924 | A1 * | 3/2013 | B61F 5/06 |

* cited by examiner

SECONDARY SPRING HAVING AN INTEGRATED TRANSVERSE STOP

BACKGROUND OF THE INVENTION

Field of the Invention

The invention relates to a secondary spring for springing a wagon body of a rail vehicle on a chassis of the rail vehicle, and to a rail vehicle.

Secondary springs, by way of example designed as hour glass springs, are arranged between a chassis and a wagon body of a rail vehicle in order to spring the wagon body on the chassis. They serve to transfer traction, vertical and lateral forces between the chassis and the wagon body. For this purpose they are normally screwed to the wagon body and to the chassis. In order to limit the movements between the wagon body and the chassis mechanical end stops which are complementary with one another are additionally provided in the form of vertical and horizontal stops on the wagon body and on the chassis. These are also called transverse and vertical stops. These prevent collisions and thus damage to the chassis components or components of the wagon body.

BRIEF SUMMARY OF THE INVENTION

The object of the invention is to prevent damage to the chassis components or to components of the wagon body in a simple and cost-effective manner.

This is achieved by the subject of the independent patent claim. Further developments and configurations of the invention are found in features of the dependent patent claims.

A secondary spring according to the invention for springing a wagon body of a rail vehicle on a chassis of the rail vehicle, in particular on a bogie of the rail vehicle, comprises a first and at least a further second section, which first section is designed to be stiff along a predefined axis and springy orthogonally to the predefined axis and which second section is designed stiff orthogonally to the predefined axis and springy along the predetermined axis. The secondary spring furthermore comprises at least one horizontal stop which is arranged on the secondary spring such that a force which acts on the horizontal stop orthogonally to the predefined axis is introduced into the secondary spring between the first and the second section.

The first section is to be designated stiff or hard along the predefined axis. It is designed springy or flexibly orthogonally to the predefined axis. Analogously the second section is designed stiff or hard orthogonally to the predefined axis and is designed springy or flexibly along the predefined axis. Stiff or hard does not mean in this connection that the relevant section of the secondary spring is absolutely free of deflection in the corresponding direction. Even in this direction the section of the secondary spring can have a certain elasticity. If a section of the secondary spring is however to be designated as stiff or hard in one direction the spring constant in this direction is clearly greater than in a direction in which the section of the secondary spring is designed springy or flexibly.

The predefined axis runs by way of example parallel to a longitudinal axis of the secondary spring. In particular it coincides with the longitudinal axis of the secondary spring. The main spring direction of the secondary spring, thus in a predefined operating position of the secondary spring the direction perpendicular to the ground surface, likewise runs in a further development parallel to or along the predefined axis. The wagon body of the rail vehicle is then sprung on a chassis of the rail vehicle in the main spring direction of the secondary spring, which is produced in particular by the second section of the secondary spring. It is however also sprung relative to the chassis radially to the main spring direction at least by the first section of the secondary spring which is springy orthogonally to the main spring direction.

In the predefined operating position the secondary spring is arranged between the chassis and the wagon body of the rail vehicle in such a way that the predefined axis of the second spring points in the vertical direction and thus runs parallel to a vertical axis of the wagon body and thus the first section of the secondary spring is designed vertically stiff and horizontally springy and the second section is designed horizontally stiff and vertically springy. A force acting on the horizontal stop in the horizontal direction is introduced into the secondary spring between the first and the second section.

The secondary spring is in particular divided along the predefined axis into a first and at least one further second section. According to a further development the first and the second section are separated from one another by a partition plate. The partition plate is thus arranged between the first and the second section of the secondary spring.

The partition plate is formed stiff both axially and also radially relative to the predefined axis. By way of example it is made from a metal or a metal alloy. In particular it is made from steel.

The partition plate can also be designed suitable for transferring forces in the direction of the predefined axis of the secondary spring to the secondary spring. It is thus possible to pretension the second section of the secondary spring against the wagon body of the rail vehicle by means of a predefined clamping tool by means of which a force can be applied which engages on the partition plate, and which acts in a direction towards the wagon body and thus against the spring force of the second section of the secondary spring.

A force which acts on the partition plate orthogonally to the predefined axis is introduced via the partition plate into the secondary spring between the first and the second section of the secondary spring. The partition plate is thus configured at least as part of the horizontal stop. According to one embodiment it forms the horizontal stop. Then it can project over at least the first section in at least one direction orthogonally to the predefined axis in order to arrive at a stop against a complementary designed horizontal stop of the chassis.

In order to limit the horizontal movements of the wagon body of the rail vehicle relative to the chassis a fixed horizontal stop is arranged on the chassis side, this stop formed complementary with the horizontal stop of the secondary spring. This fixed horizontal stop comprises by way of example a fixed stop plate. This can comprise similar materials analogous with the partition plate of the secondary spring, and can also be made of steel. The horizontal stop of the chassis is aligned towards the horizontal stop of the secondary spring and lies as a stop plate in particular in a vertical plane parallel to a longitudinal direction of the chassis. Colloquially two stops formed and aligned complementary with one another make up one double-sided stop.

One advantage of a secondary spring according to the invention lies in the fact that the horizontal stop is integrated into the secondary spring whereby no further horizontal stops are required on the wagon body of the rail vehicle.

According to a further development of the invention the first and the second sections are formed coaxially relative to one another. By way of example the first and the second sections are each formed rotationally symmetrical and are arranged relative to one another in such a way that they have a common axis of rotation.

A further embodiment proposes that the first section comprises a layer spring which is stiff along the predefined axis and springy orthogonally to the predefined axis, and/or that the second section comprises a cone spring, in particular a rubber-metal spring, which is stiff orthogonally to the predefined axis and springy along the predefined axis.

According to a further configuration of the secondary spring according to the invention the first section is provided and is suitable for bearing on the chassis. It is then configured correspondingly, in particular it is formed complementary to the means for the bearing of the secondary spring on the chassis, in order to come to bear on the chassis of the rail vehicle. The second section of the secondary spring is provided in an analogous manner and is suitably designed for the bearing of the wagon body.

For transferring the forces in the horizontal direction the chassis or the first section of the secondary spring comprises at least one journal. The relevant other part then comprises a device for receiving the journal. The journal is arranged in particular centrally in the first section of the secondary spring and protrudes at the end beyond the first section of the secondary spring.

According to one exemplary configuration the journal runs centrally in a rotationally symmetrical layer spring. The journal can then be part of the secondary spring or is part of the chassis.

The second section of the secondary spring can also comprise suitable means for transferring forces in the horizontal direction from the wagon body or to the wagon body of the rail vehicle. By way of example it is conical in shape formed as a truncated cone, wherein the wagon body then comprises a pot-shaped inversion to receive at least one end part of the second section of the secondary spring. The wagon body and the secondary spring are further designed to be connected to one another in positive engagement wherein the positive connection acts at least parallel to a vertical axis of the wagon body towards the wagon body and perpendicular to the vertical axis of the wagon body.

A chassis according to the invention, in particular a bogie, comprises at least one horizontal stop, in particular in the form of a stop plate, which is arranged and formed complementary with the horizontal stop of the second spring. Furthermore it can comprise suitable means for the bearing of at least one secondary spring according to the invention on the chassis and means for absorbing forces in the horizontal direction. The chassis is designed as a bogie depending on use.

The rail vehicle is in particular a drop-floor vehicle. It can comprise several wagon bodies and several chassis, by way of example bogies. Naturally then several secondary springs are also provided for springing the wagon bodies on the chassis. In a further development one wagon body of the rail vehicle is sprung on just one chassis. Several secondary springs, by way of example just two, can be provided for springing a wagon body on a chassis. A chassis can comprise one, in particular however just two, longitudinally positioned drive motors.

In a further development of the invention it is proposed that the chassis comprises two drive motors arranged parallel to a longitudinal axis of the chassis, wherein two secondary springs are provided for springing the wagon body on the chassis, which are arranged between the drive motors, in particular on a line perpendicular to a longitudinal axis of the chassis. The connecting points of the secondary springs to the chassis then lie on a line. In a further development this line divides the chassis into a front and a rear part which are substantially the same size—it lies in a transverse center plane.

A further development proposes that the chassis comprises at least one drive motor which is arranged parallel to the longitudinal axis of the chassis and on which the horizontal stop is arranged, this horizontal stop formed complementary with the horizontal stop of the secondary spring. The horizontal stop can then be arranged directly on the drive motor; it is in particular an integral constituent part of the drive motor. In a further exemplary embodiment the chassis, which is formed in particular as a bogie, comprises at least two drive motors which are arranged parallel to the longitudinal axis of the chassis, wherein at least two secondary springs are arranged between the drive motors, in particular on a line perpendicular to the longitudinal axis of the chassis, such that each secondary spring is adjacent each one drive motor, wherein each drive motor has at least one horizontal stop which is formed complementary with a horizontal stop of the adjacent secondary spring. However center bogies can also comprise horizontal stops which are fixed by way of example on the center bogies by way of console brackets.

A rail vehicle according to the invention comprises at least one wagon body, at least one secondary spring according to the invention, and at least one chassis according to the invention, in particular a bogie.

The wagon body comprises suitable means in order to bear on the at least one secondary spring according to the invention. It can also furthermore have means for taking up forces in the horizontal direction.

Forces in the horizontal direction can also be termed transverse forces whereby a horizontal stop can also be called a transverse stop.

The secondary spring is according to one embodiment arranged between the chassis and the wagon body of the rail vehicle so that the predefined axis of the secondary spring is aligned substantially vertically. The main spring direction thus corresponds to the vertical direction and runs in particular parallel to the longitudinal axis of the secondary spring or coincides with the latter. The first section of the secondary spring is then formed vertically stiff and horizontally springy and the second section of the secondary spring is thus formed horizontally stiff and vertically springy.

According to a further development the first section of the secondary spring is supported on the chassis and the wagon body of the rail vehicle is supported on the second section of the secondary spring. The first section is thus located underneath the second section.

In a further development more particularly two secondary springs are arranged between the wagon body and the chassis for springing the wagon body of the rail vehicle on the chassis.

The secondary springs, in particular their horizontal stops, are arranged relative to the horizontal stops of the chassis, such that the latter can act on one another at least in pairs in order to restrict the horizontal movement of the wagon body relative to the chassis.

Horizontal movements of the chassis relative to the wagon body and vice versa are restricted by means of the horizontal stop pairings of the secondary spring and chassis. In order to restrict vertical movements, the chassis and the wagon body can each have at least one vertical stop which are formed and aligned complementary with one another. Vertical stops can also be called upright stops.

According to a further development the at least one wagon body of the rail vehicle is free of horizontal stops for stopping against complementary horizontal stops of the chassis. Thus no direct horizontal stops are provided between the wagon body and the chassis.

The invention permits numerous embodiments. It will now be explained in detail with reference to the following figures in which an exemplary embodiment is shown each time. The same elements in the figures are provided with the same reference numerals.

DESCRIPTION OF THE INVENTION

Figure 1:
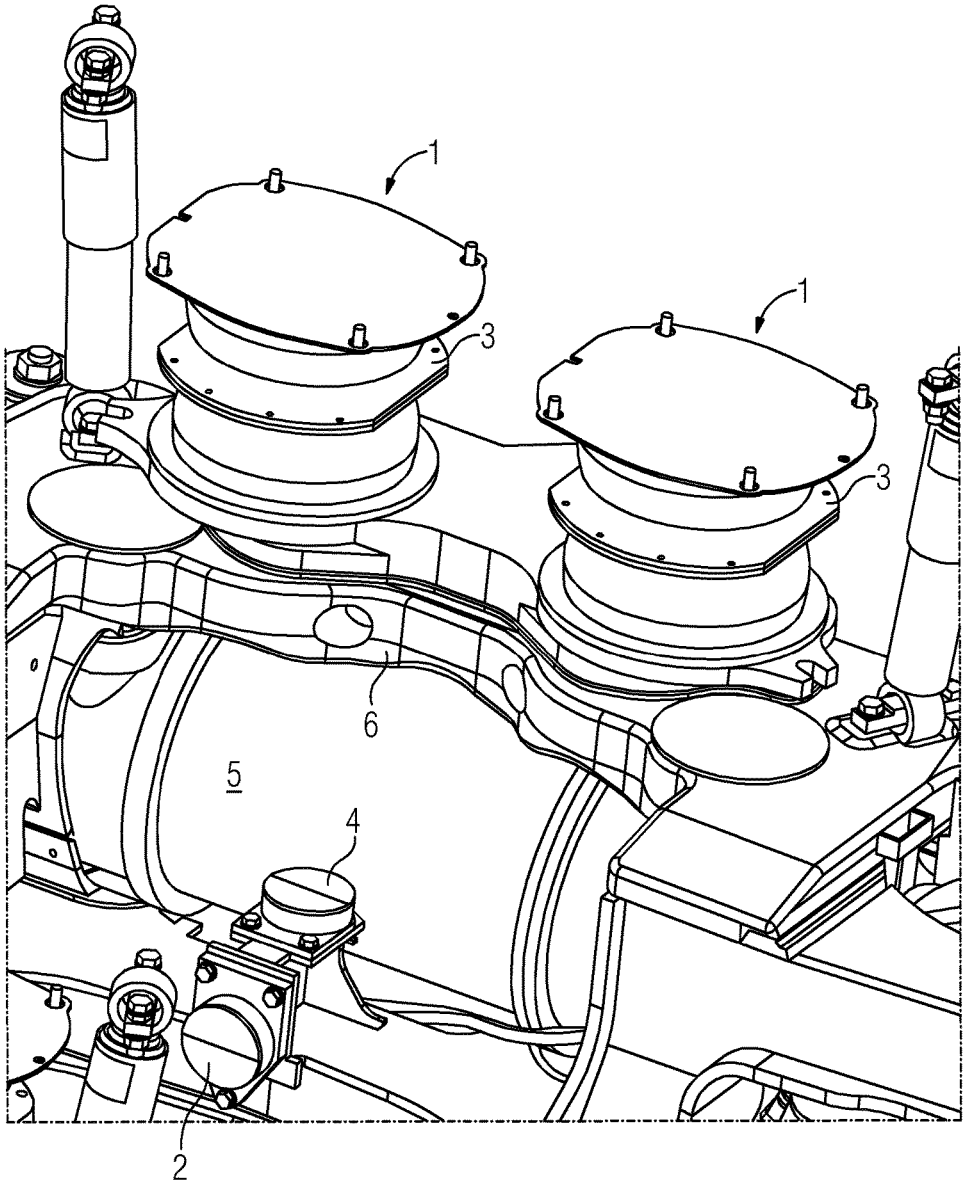
FIG 1 PRIOR ART
FIG. 1 shows in a perspective view a bogie of the prior art.

FIG. 1 shows a bogie of the prior art partly in a perspective view. Two structurally identical secondary springs 1 are attached to a crossbeam 6 above a drive motor 5 arranged on the longitudinal side for springing a wagon body (not shown) on the bogie. In total four secondary springs are arranged between the bogie and the wagon body, of which only the secondary springs on one side of the bogie have been drawn in. They are formed as hour glass springs. They have in longitudinal section the form of a sandglass with a part which narrows relative to two opposing end sides. A partition plate 3 is arranged in the middle of each secondary spring 1.

In order to restrict movements of the bogie relative to the wagon body the bogie as well as the wagon body have several horizontal and vertical stops. Here are shown a horizontal stop 2 and a vertical stop 4 of the bogie. Each horizontal stop of the bogie and a horizontal stop of the wagon body formed and arranged complementary therewith come to bear against one another in the event of a thereby restricted relative movement of the bogie relative to the wagon body. The same applies for the vertical stops.

Figure 2:
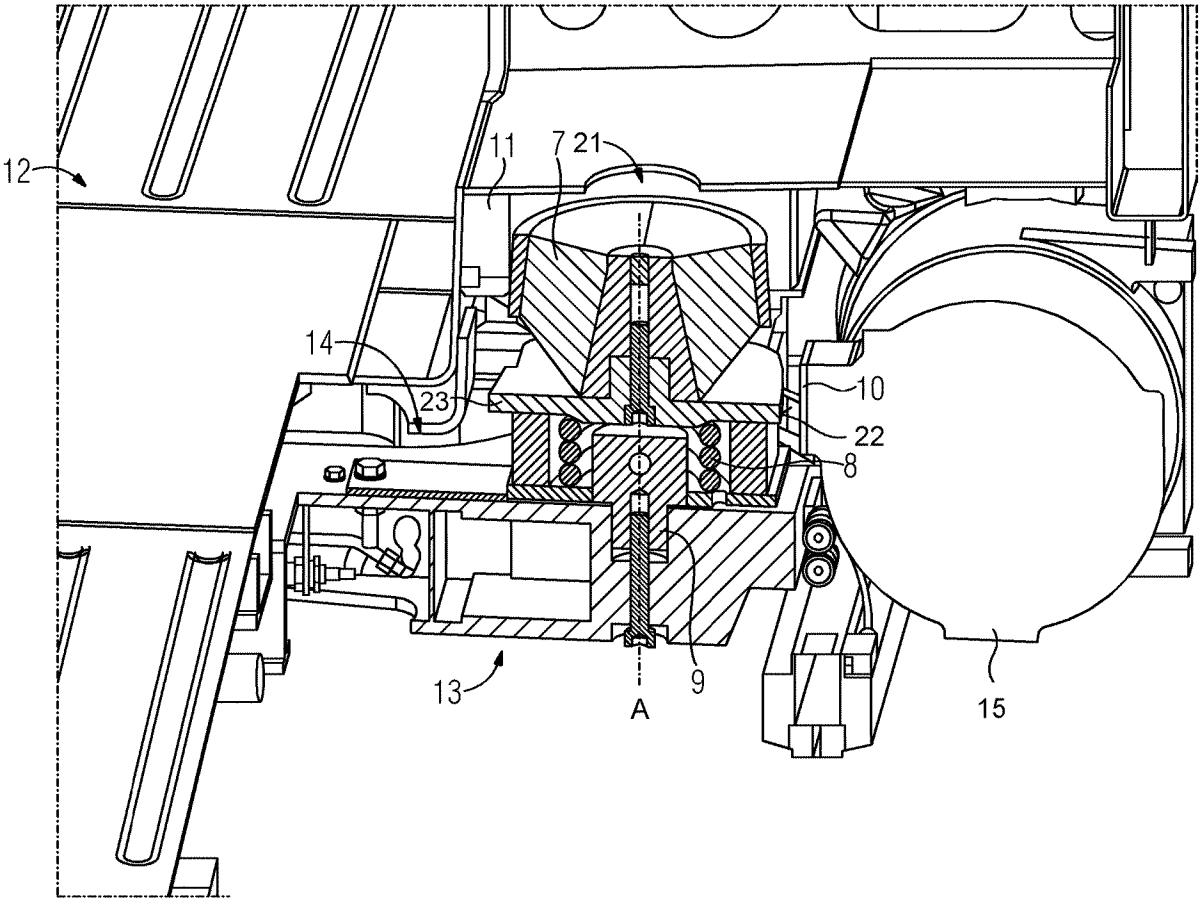
FIG. 2 shows a secondary spring according to the invention on a bogie in partial sectional view.

FIG. 2 now shows in a partial sectional view a secondary spring 21 according to the invention in the mounted position on a bogie 13.

The secondary spring 21 has here a first section 8 which comprises a vertically stiff and horizontally springy layer spring, and it has a further second section 7 which comprises a horizontally stiff and vertically springy cone spring, here a rubber-metal spring.

The secondary spring 21 is divided here into a lower and an upper section, wherein it is arranged in its predefined operating position between the bogie 13 and the wagon body 12 of the rail vehicle so that the first section 8 is mounted on the bogie 13, wherein the second section 7 is connected to the wagon body 12 of the rail vehicle. The first section 8 thus forms the lower section of the secondary spring 21. The second section 7 embodies the upper section.

The sections 7, 8 have a common axis of rotation A. This is at the same time the longitudinal axis of the secondary spring 21. In its operating position this axis points in the vertical direction. This axis runs here along a journal 9 arranged centrally in the first section 8 of the secondary spring 21.

In order to restrict the horizontal movements between the bogie 13 and the wagon body 12 both the bogie 13 and also the secondary spring 21 have horizontal stops 22 and 10 which are designed and aligned complementary with one another. Both horizontal stops 22 and 10, when positioned against one another, serve to absorb forces in the horizontal direction of each other horizontal stop. The wagon body 12 is on the other hand free of horizontal stops.

The horizontal stop 22 of the secondary spring 21 comprises here a partition plate 23 between the first and the second section 8 and 7 of the secondary spring 21. A fixed horizontal stop 10 is provided in the form of a stop plate for the partition plate 23 of the secondary spring 21 on the side of the bogie on a drive motor 15 which is arranged on a longitudinal side.

The horizontal stop in the form of the partition plate 23 of the secondary spring 21 is then arranged on the secondary spring 21 and connected to same so that a force acting in the horizontal direction on the horizontal stop 22 can be introduced into the secondary spring 21 between the first and the second section 8 and 7.

Transverse forces, thus forces in the horizontal direction, are transferred from the bogie 13 to the secondary spring 21 or from the secondary spring 21 to the bogie 13 via the journal 9 which is arranged centrally in the layer spring. For this the bogie 13 has a correspondingly complementary formed socket for the journal 9. In an analogous manner transverse forces are transferred from the wagon body 12 to the secondary spring 21 or from the secondary spring 21 to the wagon body 12 by means of a suitable interface. The second section 7 of the secondary spring 21 has here the form of a truncated cone, which is housed in a pot-shaped indentation 11 of the wagon body 12. The pot-shaped indentation 11 of the wagon body 12 which is coaxial with the secondary spring, and the second section 7 of the secondary spring 21 form in particular a snug fit.

The wagon body and the secondary spring are thereby connected to one another in positive engagement, wherein this positive connection acts at least parallel to a vertical axis of the wagon body towards the wagon body and perpendicular to the vertical axis of the wagon body.

In order to restrict vertical movements, the wagon body 12 has a vertical stop 14. This can come to abut against the bogie 13.

The invention claimed is:

1. A rail vehicle, comprising:

at least one wagon body;

at least one chassis;

at least one secondary spring for springing said wagon body on said chassis, said at least one secondary spring containing:

a first section;

a second section, said first and second sections divided along a longitudinal axis, said second section configured to be axially resilient, said first section configured to be resilient orthogonally to the longitudinal axis; and at least one horizontal stop disposed such that a force acting on said horizontal stop orthogonally to the longitudinal axis is introduced into said secondary spring between said first and said second sections; and said chassis having at least one further horizontal stop configured complementary with said horizontal stop of said secondary spring; and said chassis having at least one drive motor disposed parallel to a longitudinal axis of said chassis and said at least one further horizontal stop is disposed on said drive motor.

2. A rail vehicle, comprising:

at least one wagon body;

at least one chassis;

at least one secondary spring for springing said wagon body on said chassis, said at least one secondary spring containing:

a first section;

a second section, said first and second sections divided along a longitudinal axis, said second section configured to be rigid orthogonally to the longitudinal axis and axially resilient, said first section configured to be axially rigid and resilient orthogonally to the longitudinal axis; and at least one horizontal stop disposed such that a force acting on said horizontal stop orthogonally to the longitudinal axis is introduced into said secondary spring between said first and said second sections;

said chassis having at least one further horizontal stop configured complementary with said horizontal stop of said secondary spring; and said chassis having at least one drive motor disposed parallel to a longitudinal axis of said chassis and said at least one further horizontal stop is disposed on said drive motor.

3. The rail vehicle according to claim 1, wherein:

said chassis has at least two drive motors disposed parallel to a longitudinal axis of said chassis;

said at least one secondary spring is one of at least two secondary springs which are disposed between said drive motors such that each of said secondary springs is adjacent each of said drive motors; and each of said drive motors has said at least one further horizontal stop which is configured complementary with said horizontal stop of an adjacent one of said secondary springs.

4. The rail vehicle according to claim 1, wherein said first section of said secondary spring is mounted on said chassis, and said wagon body is mounted on said second section of said secondary spring.

5. The rail vehicle according to claim 1, further comprising a journal, said first section of said secondary spring is connected to said chassis by said journal running axially to the longitudinal axis of said secondary spring for a transfer of forces in a horizontal direction to said chassis.

6. The rail vehicle according to claim 1, wherein said at least one wagon body is free of horizontal stops for stopping against said further horizontal stop of said chassis.

* * * * *